US005191260A

United States Patent [19]

Kawai et al.

[11] Patent Number: 5,191,260

[45] Date of Patent: Mar. 2, 1993

[54] GAS DISCHARGE TUBE PROVIDING IMPROVED FLOW LINE OF ELECTRONS

[75] Inventors: Koji Kawai; Yuji Shimazu, both of Hamamatsu, Japan

[73] Assignee: Hamamatsu Photonics K.K., Shizuoka, Japan

[21] Appl. No.: 749,367

[22] Filed: Aug. 23, 1991

[30] Foreign Application Priority Data

Aug. 27, 1990 [JP] Japan ..... 2-225918
Jan. 25, 1991 [JP] Japan ..... 3-025769

[51] Int. Cl.[5] ..... H01J 17/04; H01J 61/10; H01J 61/12

[52] U.S. Cl. ..... 313/613; 313/589; 313/112; 313/637

[58] Field of Search ..... 313/613-616, 313/589, 112, 637, 643

[56] References Cited

U.S. PATENT DOCUMENTS 3,956,655 5/1976 Pevo ..... 313/110
4,611,143 9/1986 Shimazu et al. ..... 313/637

*Primary Examiner*—Sandra L. O'Shea

*Attorney, Agent, or Firm*—Sughrue, Mion, Zinn, Macpeak & Seas

[57] ABSTRACT

A gas discharge tube having an outer envelope in which deuterium gas is filled. In the envelope, an anode, a cathode and a first shield cover for surrounding these electrodes are disposed. A second shield cover is disposed within the first shield cover and at a position adjacent the anode to divide an internal space defined by the first shield cover into a first chamber in which the anode is positioned and a second chamber in which a cathode is positioned. A plasma arc generating portion is positioned at the second shield cover. A plasma arc generated on the plasma arc generating portion provides an optical axis extending linearly toward the outer envelope through an opening of the first shield cover. The cathode is disposed at a position offset from the optical axis for providing a flow line of electrons from the cathode to the anode in a direction obliquely with respect to the optical axis. A shield member is further provided at a position immediately adjacent the plasma arc generating portion for largely bending the flow line of the electrons at a tip end portion of the shield member and for directing the flow line substantially coincident with the optical axis.

10 Claims, 6 Drawing Sheets

GAS DISCHARGE TUBE PROVIDING IMPROVED FLOW LINE OF ELECTRONS

BACKGROUND OF THE INVENTION

The present invention relates to a gas discharge tube such as a deuterium lamp for spectrographic use in an qualitative or quantitative analysis.

The deuterium lamp has high output in ultraviolet region and provides a stable and continuous spectrum. Therefore, the lamp is widely available in spectrophotometers, fluorescent spectrometers and other optical devices which require such ultraviolet light sources in order to carry out ultraviolet spectrometry for measuring spectral transmission characteristics and spectral absorption coefficients etc. of material to be examined.

One example of a conventional gas discharge tube 1 (a deuterium lamp) is shown in FIGS. 1 through 3. The gas discharge tube 1 generally includes an anode 3, a cathode 8, a shield cover 4 for these electrodes and an outer envelope 12. The anode 3 is provided on an optical axis 2 defined within the outer envelope 12, and the anode 3 is surrounded by the shield cover 4. In front of the anode 3, a conical apertured portion 5 formed of a molybdenum is provided which is integrally assembled to the shield cover 4. As best shown in FIG. 3, the conical apertured portion 5 is provided with a small diameter bore portion 5*a* at the anode side and a conical surface portion 5*b* provided contiguously therewith. The small diameter bore portion 5*a* has an inner diameter of 0.4 to 2.0 mm and an axial length L2 of 0.5 mm. The conical surface portion 5*b* has an apex angle $\theta$ of 60° and an axial length L1 of 1.3 mm.

In front of the conical apertured portion 5, a light transmitting hole 7 is open for allowing light to pass therethrough. Further, at one side of the conical apertured portion 5, the cathode 8 is provided. Three sides of the cathode 8 are surrounded by the shield cover 4. However, remaining one side of the cathode 8 is provided with a shield member 10' whose edge 14 defines an opening which is open with respect to an electron path 9 along which electrons directing toward the anode 3 are passed.

According to the deuterium lamp 1 of this type, deuterium gas having pressure of several Torrs is enclosed within the envelope 12 formed of the transparent glass such as fused silica or UV-transmitting glass. The envelope 12 provides a light emitting portion 13 which is positioned on the optical axis 2. The optical axis 2 extends in a line connecting between a center of the small diameter bore portion 5*a* and a center of the light transmitting hole 7 formed in the shield cover 4.

After preheat to the cathode 8, a trigger voltage is applied between the anode 3 and the cathode 8 for initiating arc discharge. After the discharge, a source voltage is applied for continuing the discharge. Thus, electrons pass along the flow line 9 and a plasma region 16 is provided on the conical apertured portion 5. The conical apertured portion 5 serves as an electron converging region. At the time of the arc discharge, sputtered materials are released from the cathode 8. Therefore, the shield member 10' prevents the sputtered material from the cathode 8 from being adhered onto the conical apertured portion 5 and a light emitting portion 13 of the glass envelope 1, to thereby obviate reduction in reflection efficiency and light transmittance. Incidentally, according to the above described arrangement, the cathode 8 is not positioned in confrontation with the anode 3, but is positioned offset therefrom. This is due to the fact that if the cathode 8 is positioned in directly front of the anode 3, light beam emitted from the conical apertured portion 5 is interrupted by the cathode 8. Further, the above described sputtered materials may be easily adhered onto the conical surface portion 5*b* and the light emitting portion 13. Furthermore, by the deviating arrangement of the cathode 8, the electron path length can be elongated by making use of the curved flow line, so that acceleration to the electron is obtainable at the conical apertured portion 5 in order to effectively provide the plasma arc thereat.

SUMMARY OF THE INVENTION

As described above, the shield member 10' prevents the sputtered material from being dispersed or scattered. However, it has been found that the position of the shield member 10' imparts a significant effect on increase in brightness of the lamp. That is, in the gas discharge tube, electron density is increased in accordance with the convergence of the electrons into the conical apertured portion 5 at the time of the discharge. As a result, probability of the impingement of electrons against the enclosed gas is enhanced. Thus, light emitting intensity because of the impingement can be increased. On the other hand, in the discharge, the electrons inherently flow along a short-cut path or "minimum" length, and therefore, resultant electron path 9 bridging between the cathode 8 and the anode 3 has a minimum length as small as possible. Accordingly, the electron path 9 passes through a position immediately adjacent the tip end portion 14 of the shield member 10' and through a position immediately adjacent the cathode side of the upper surface of the conical apertured portion 5. As a result, according to the conventional gas discharge tube, the plasma region 16 generated at the electron converging portion on the conical apertured portion 5 is deviated from the optical path 2 toward the side of the cathode 8 as best shown in FIG. 3. Consequently, the plasma region 16 expands, and several plasma region as defined by an area Z in FIG. 3 does not serve as a light source. This expansion of the plasma region may restrain the increase in brightness of the gas discharge tube which must provide a point light source.

Thus, the present inventors have found that the arrangement of the shield member 10' and/or an axial length or depth L1 of the conical surface portion 5*b* are one of the most significant factors for increasing brightness. As described above, the plasma arc region 16 can be provided by the convergence of the accelerated electrons at the conical apertured portion 5 and their impingements against the gas hermetically filled within the envelope 12. However, as described above, since the flowing electrons have their tendencies to flow along the short-cut path, the generated plasma region 16 may be deviated toward the cathode, to thereby degrade the performance of the gas discharge tube 1.

It is therefore, an object of the present invention to provide a gas discharge tube capable of providing improved brightness by confining a plasma region within a restricted area on a conical portion in order to serve as a point light source.

Another object of the invention is to provide such gas discharge tube providing an improved electron flow line bridging between a cathode and an anode by suitably setting a position and shape of a shielding member.

Still another object of the invention is to provide such gas discharge tube in which the plasma region is formed within the shielding member and exactly on the conical apertured portion for avoiding deviating orientation of the plasma region.

These and other objects of the present invention will be attained by providing a gas discharge tube comprising (a) an outer envelope in which a gas is hermetically enclosed, (b) an anode disposed in the outer envelope, (c) a cathode disposed in the outer envelope, a flow line of electrons being provided between the cathode and the anode, (d) a first shield cover for surroundingly covering the anode and the cathode, the first shield cover having a front section formed with an opening which has a center point, (e) a second shield cover positioned inside the first shield cover at a position immediately adjacent the anode and between the cathode and the anode, (f) a plasma arc generating portion positioned at the second shield cover for generating a plasma arc, the plasma arc generating portion having one end formed with a bore which provides a center point and confronts the anode and another end formed with an internal conical portion and confronting the front section of the first shield cover, an optical axis extending on a line connecting between the center points of the bore and the opening, and the cathode being positioned offset from the optical axis, and (g) a shield member positioned between the cathode and the anode and at a position immediately adjacent the another end portion of the plasma arc generating portion for largely bending the flow line of the electrons at a tip end portion of the shield member and for directing the flow line substantially coincident with the optical axis.

DETAILED DESCRIPTION OF THE PREFERRED EMBODIMENTS

Figure 1:
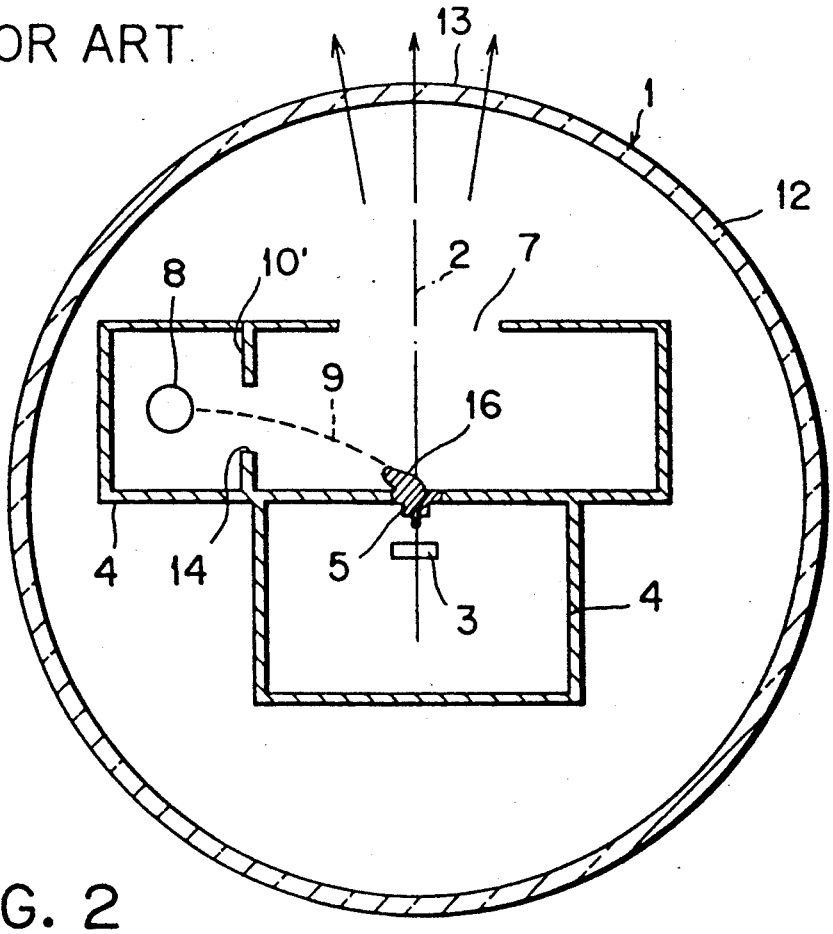
FIG. 1 PRIOR ART
FIG. 1 is a transverse cross-sectional view showing a conventional gas discharge tube.
Figure 2:
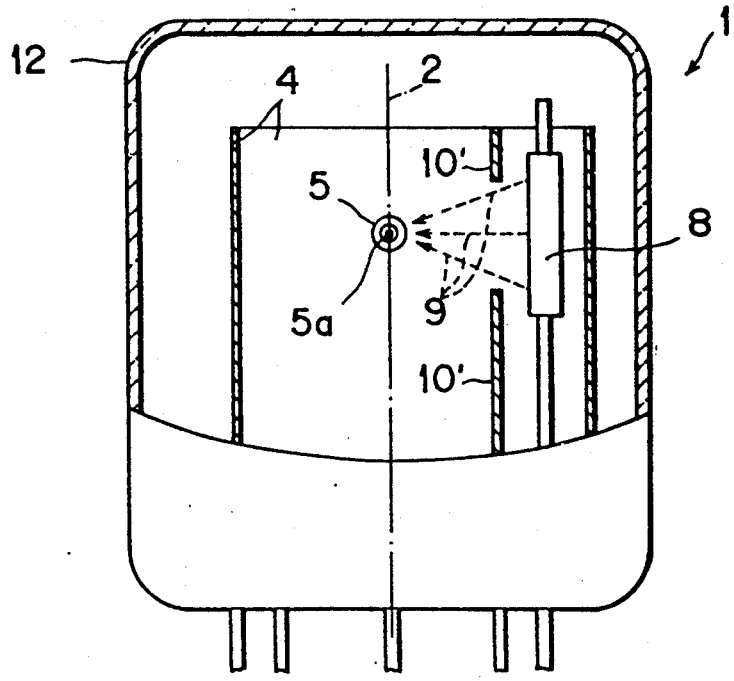
FIG. 2 PRIOR ART
FIG. 2 is a vertical cross-sectional view of FIG. 2.
Figure 3:
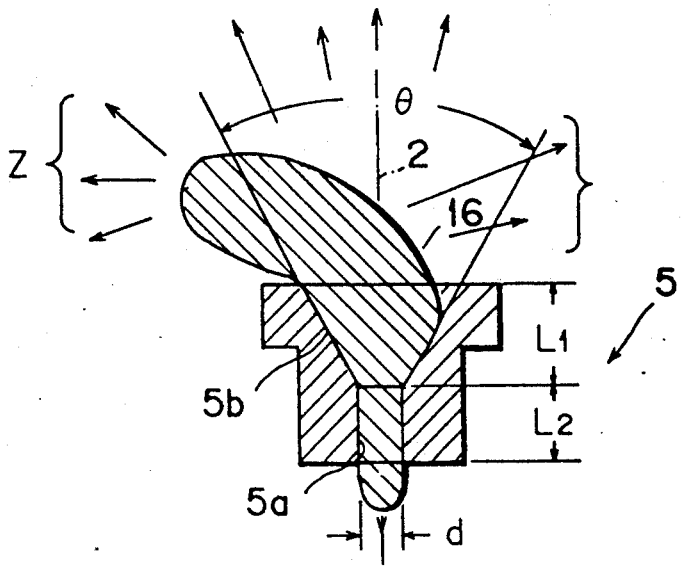
FIG. 3 PRIOR ART
FIG. 3 is an enlarged cross-sectional view particularly showing a conical apertured portion of the conventional gas discharge tube shown in FIGS. 1 and 2.

A gas discharge tube according to a first embodiment of the present invention will be described with reference to FIGS. 4 and 5, wherein like parts and components are designated by the same reference numerals as those shown in FIGS. 1 through 3 to avoid duplicating description.

A fundamental structural difference of gas discharge tubes between the first embodiment and the conventional tube resides in a shield member 10. More specifically, a tip end portion 14 of the shield member 10 according to the first embodiment of this invention is positioned as close as possible to an electron convergent portion on the conical apertured portion 5. That is, a base end portion 17 of the shield member 10 is positioned away from the conical apertured portion 5 similar to the conventional arrangement. However, the tip end portion 14 is positioned close to the conical apertured portion 5. Therefore, electron flow line 9 bridging between a cathode 8 and the anode 3 can be largely bent because of the obstacle disposition of the shield member 10. For example, the tip end portion 14 is positioned close to an intersecting point 20 defined by an intersection of a first line 18 extending through a center of the cathode 8 and perpendicular to the optical axis 2 and a second line 19 extending through an upper edge 15*a* of the conical apertured portion 5 and directing in parallel with the optical axis 2. Further, a vertical length L of the shield member 10 is made larger than an axial length of an electron radiating portion of the cathode 8 as shown in FIG. 5. The shield member 10 is of linear plate like form as shown in FIG. 5. Incidentally, in FIG. 4, a conventional shield member 10' is shown by a dotted chain line. It should be noted that the conventional shielding plate 10' can be remained in a resultant structure in addition to the shield member 10. Because of the provision of the shield member 10 of this invention, the conventional shield member 10' does not perform its inherent function. However, the conventional shield member 10' can enhance mechanical strength of the resultant structure.

Figure 4:
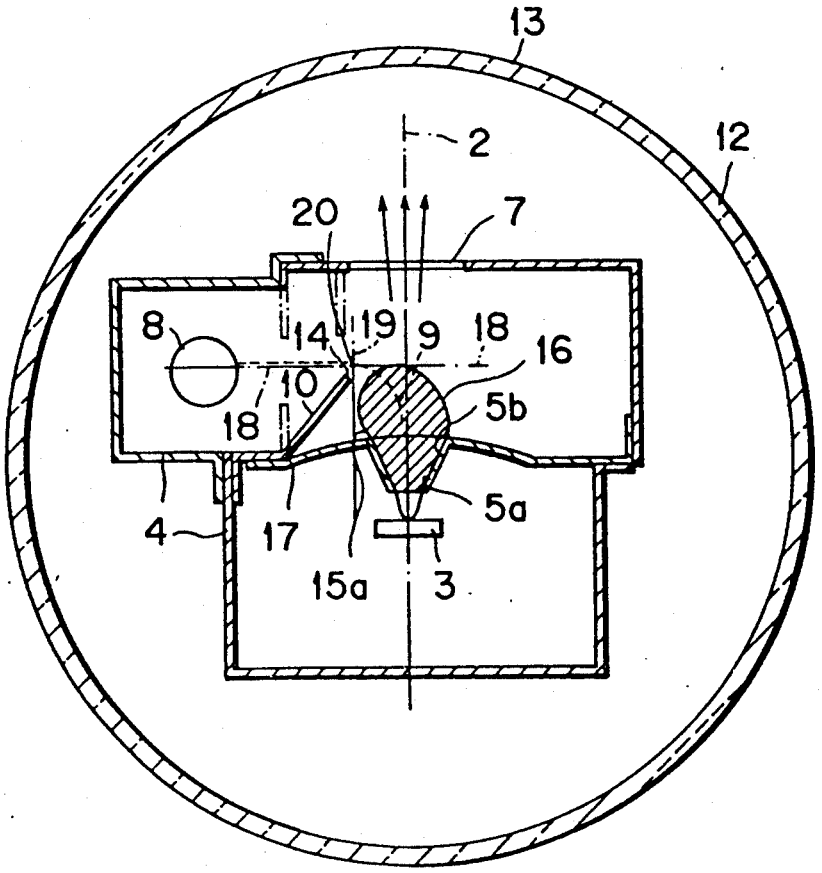
FIG. 4 is a transverse cross-sectional view showing a gas discharge tube according to a first embodiment of this invention.
Figure 5:
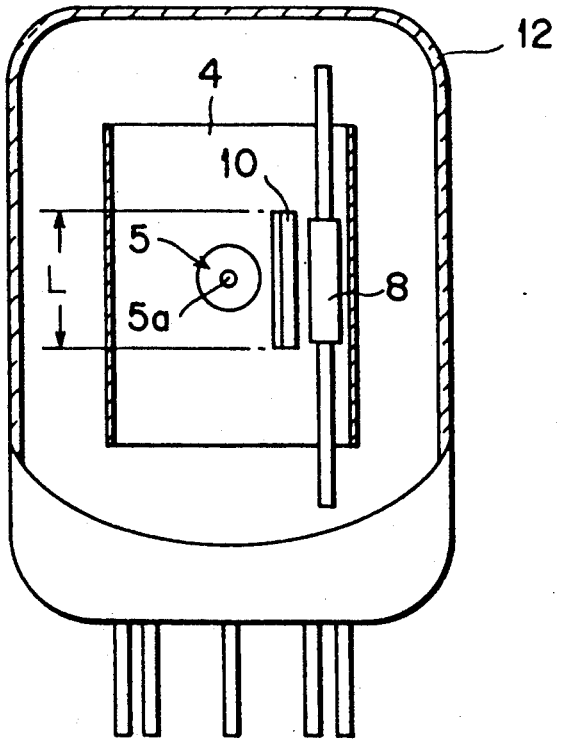
FIG. 5 is a vertical cross-sectional elevation of the first embodiment.

With the structure described above, the electron path 9 bridging from the cathode 8 to the anode 3 is positioned adjacent to the tip end portion 14 of the shield member 10 as shown by a broken line in FIG. 4 to provide a linear incident line with allowing the flow of the electrons at the electron convergent portion to be positioned adjacent to the optical axis 2. Therefore, the plasma region 16 directing along the optical axis 2 can be formed at the electron convergent portion on the conical apertured portion 5 without any regional expansion toward the side of the cathode 8, to thus enhance brightness. In other words, the electrons cannot pass along a short cut path because of the blocking function of the shield member 10, but flows along the largely curved flow line 9. Therefore, the flow line 9 has a part extending in parallelism with the optical axis 2, as if the cathode 8 is positioned in front of the anode 3. Accordingly, highly concentrated plasma region 16 on the conical apertured portion 5 can be directed on the optical axis 2 without any deviating orientation.

Figure 6:
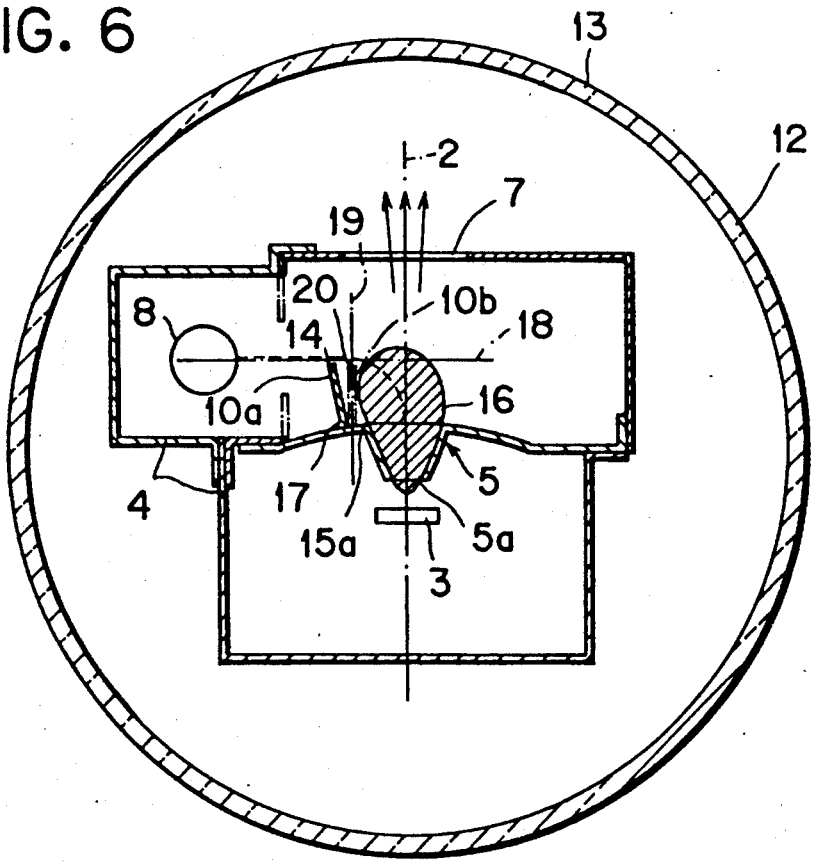
FIG. 6 is a transverse cross-sectional view showing a gas discharge tube according to a second embodiment of this invention.

A gas discharge tube according to a second embodiment of this invention will next be described with reference to FIG. 6. In the second embodiment, a base end portion 17 of the shield member 10*a* is positioned approximately on the second line 19 which is positioned close to the upper edge 15*a* of the conical portion 5, whereas the tip end portion 14 of the shield member 10*a* is positioned toward the cathode 8 with respect to the intersecting point 20 defined by the intersection between the first line 18 and the second line 19. As a modification, the position of the tip end portion 14 of a shield member 10*b* is not inclined toward the cathode 8, but can be upstandingly oriented in parallelism with the second line 19 as shown by a chain line in FIG. 6. Similar to the first embodiment, the shielding plates 10*a* or 10*b* shown in FIG. 6 have linear shapes in the lengthwise direction L of FIG. 5, and this arrangement according to the second embodiment of this invention can provide advantages the same as those of the first embodiment.

Figure 8:
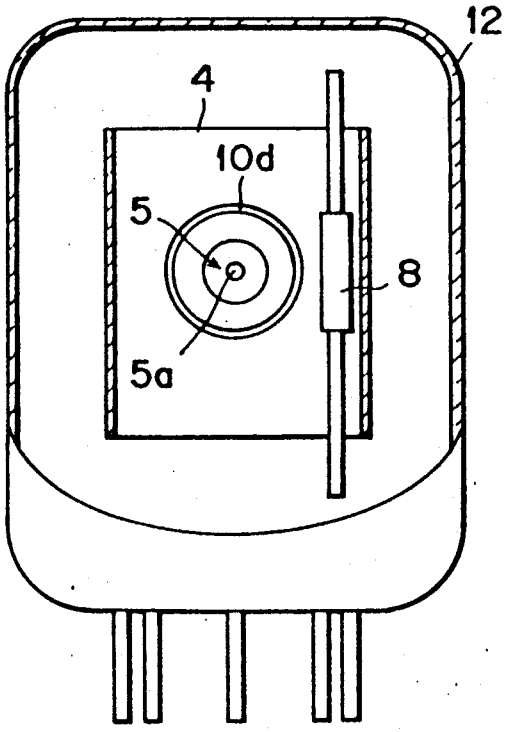
FIG. 8 is a vertical cross-sectional view showing a gas discharge tube according to a fourth embodiment in which another modification is effected to the shield member.
Figure 7:
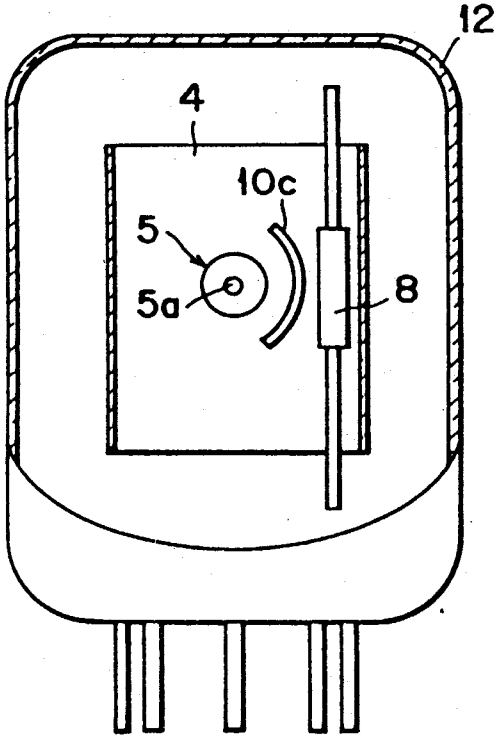
FIG. 7 is a vertical cross-sectional view showing a gas discharge tube according to a third embodiment in which a modification is effected to a shield member.

Next, gas discharge tubes according to third and fourth embodiments of this invention will be described with reference to FIGS. 7 and 8. In the third embodiment shown in FIG. 7, a shield member 10*c* can be arcuately bent whose imaginary center is coincident with a center of the conical apertured portion 5. On the other hand, in the fourth embodiment shown in FIG. 8, a shield member 10*d* is of a hollow cylindrical shape such that it concentrically surrounds an enter outer contour of the conical surface portion 5.

In the foregoing embodiments shown in FIGS. 4 through 8, the cathode 8 is positioned beside the conical apertured portion 5. However, in a fifth embodiment shown in FIG. 9, the cathode 8 can be positioned below (or above) the conical apertured portion 5. In this case, a shield member 10*e* is positioned between the cathode 8 and the conical apertured portion 5 in such a manner that the formed plasma region 16 can be provided along the optical axis 2 similar to the foregoing embodiments.

Primary concern in the first through fifth embodiment resides in a flow locus of the electrons reaching the conical apertured portion 5 so as to direct the plasma arc 16 in a direction in parallelism with the optical axis 2. On the other hand, primary concern in the sixth through eighth embodiments resides in the concentration of the plasma arc within a restricted area defined by the conical apertured portion and the shield member and the sixth through eighth embodiments are related to the fourth embodiment shown in FIG. 8.

Figure 10:
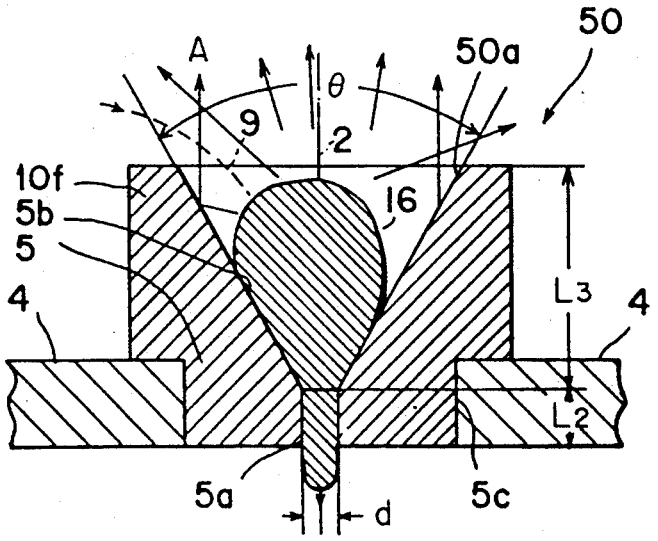
FIG. 10 is a vertical cross-sectional view showing an essential portion of a gas discharge tube according to a sixth embodiment of the present invention.

More specifically, in the sixth embodiment shown in FIG. 10, an integral plasma arcing segment 50 is provided in which a conical apertured section 5 and shield member section 10*f* are provided integrally with each other. The integral segment 50 has a reduced outer diameter section 5*c* attached to a shield cover 4. The integral plasma arcing segment 50 is made of a metal such as molybdenum. Similar to the foregoing embodiments, the conical apertured section 5 includes a small diameter bore portion 5*a* and a conical surface portion 5*b* in communication therewith. The small diameter bore portion 5*a* has a depth $L_2$ of 1 mm and an inner diameter d of from 0.4 to 2.0 mm, preferably 0.6 mm. The conical surface portion 5*b* has an inner conical surface contiguous with an inner conical surface of the shield member section 10*f*. Resultant inner conical surface 50*a* has an apex angle $\theta$ of from 30 to 120 degrees, preferably 60 degrees, and has a depth $L_3$ not less than 2 mm, preferably 4 mm, which is sufficiently large for confining a plasma region 16 within the resultant conical surface portion.

Incidentally, the small diameter bore portion 5*a* is a necessary element. If the small diameter bore portion 5*a* is not provided but the conical surface portion 5*b* is directly exposed to the anode, a knife edge portion is provided at the portion confronting the anode. This knife edge portion may be easily damaged by the elelectrons acceleratingly impinging on the knife edge portion. Therefore, the small diameter bore portion having a thickness of 1 mm is required so as to prevent the conical surface portion 5*b* from being damaged by the electrons.

By deeply arranging the resultant conical portion 50*a*, the electron path 9 bridging form the cathode 8 to the anode 3 is positioned adjacent to the optical axis 2 at the position inside the resultant conical portion 50*a* as shown by a broken line in FIG. 10, so that a flow of the electrons is approximately linearly oriented at a position close to the anode (not shown). Therefore, the plasma region 16 is formed in the resultant conical portion 50*a* and directs along the optical axis 2 without any expansion toward the cathode 8. Further, even if there are any light directing sidewards from the plasma region 16 (see arrow A in FIG. 10), such light is reflected at an inner surface of the resultant conical portion 50*a* and bent toward the optical axis 2. Accordingly, extremely small loss is provided, to thus enhance brightness.

Figure 11:
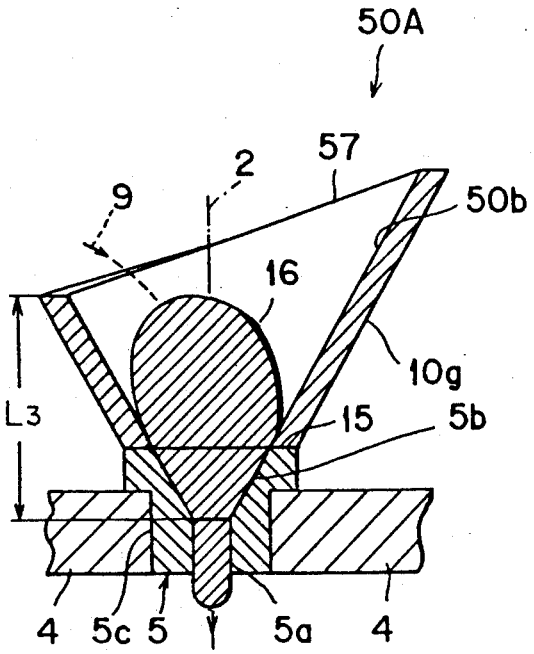
FIG. 11 is a vertical cross-sectional view showing an essential portion of a gas discharge tube according to a seventh embodiment of the present invention.

Next, FIG. 11 shows a plasma arcing segment 50A of a gas discharge tube according to a seventh embodiment of this invention, in which a funnel-shaped shield member section 10*g* is integrally connected to a conventional conical apertured section 5 at an upper surface 15 thereof in order to have the greater depth $L_3$ of a resultant conical portion 50*b*. The funnel-shaped shield member section 10*g* has an inner conical surface 50*b* contiguous with the conical surface portion 5*b*. In the illustrated embodiment, a slant upper edgeline 57 is provided in such a manner that one side (remote from a cathode) of the funnel-shaped shield member section 10*g* has a length or height larger than another side (close to the cathode and in the vicinity of the electron flow line 9) thereof in order to permit the electrons to be directed toward the anode 3 over the small height side and to enhance plasma confining function within the funnel-shaped shield member by the large height side.

Figure 9:
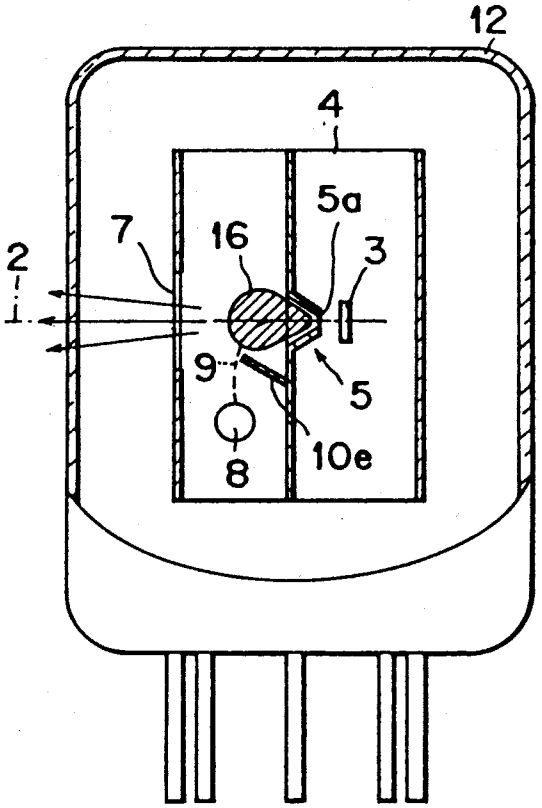
FIG. 9 is a vertical cross-sectional elevation showing a gas discharge tube according to a fifth embodiment of this invention.
Figure 12:
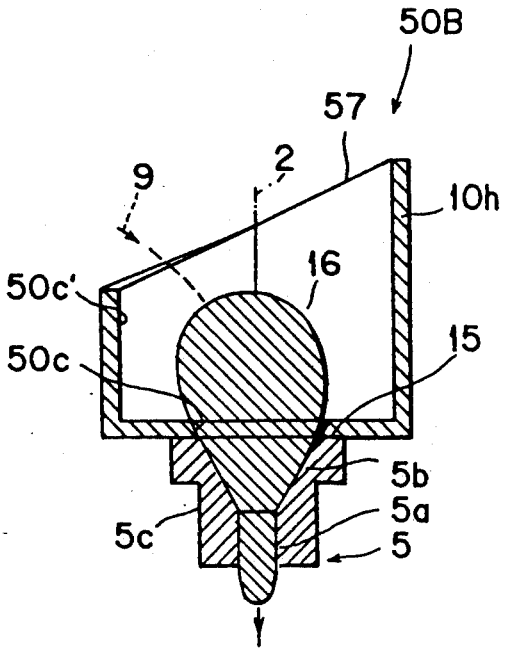
FIG. 12 is a vertical cross-sectional view showing an essential portion of a gas discharge tube according to a eighth embodiment of the present invention.

A plasma arcing segment 50B of a gas discharge tube according to a eighth embodiment will be described with reference to FIG. 11. The eighth embodiment is substantially similar to the seventh embodiment except for the configuration of a shield member section 10*h*. The shield member section 10*h* is of a hollow cylindrical shape having a diameter greater than that of the conical apertured section 5. A bottom wall of the cylindrical shield member section 10*h* is attached to the upper surface 15 of the conical apertured section 5 similar to the seventh embodiment, and a tapered bore 50*c* is formed in the bottom wall in a contiguous fashion with respect to the conical surface portion 5*b* of the conical apertured section 5. Thus, with the structures shown in FIGS. 11 and 12, plasma region 16 can be formed along the optical axis 2 similar to the foregoing embodiments for enhancing brightness. Further, it goes without saying that the sixth through eighth embodiments are also available for the gas discharge tube where the cathode is positioned below the plasma region as shown in FIG. 9. The configuration of the conical apertured section 5 and inner surface condition of the shield member section 10*f*, 10*g*, 10*h* can be modified in accordance with the intended application modes available.

Figure 13:
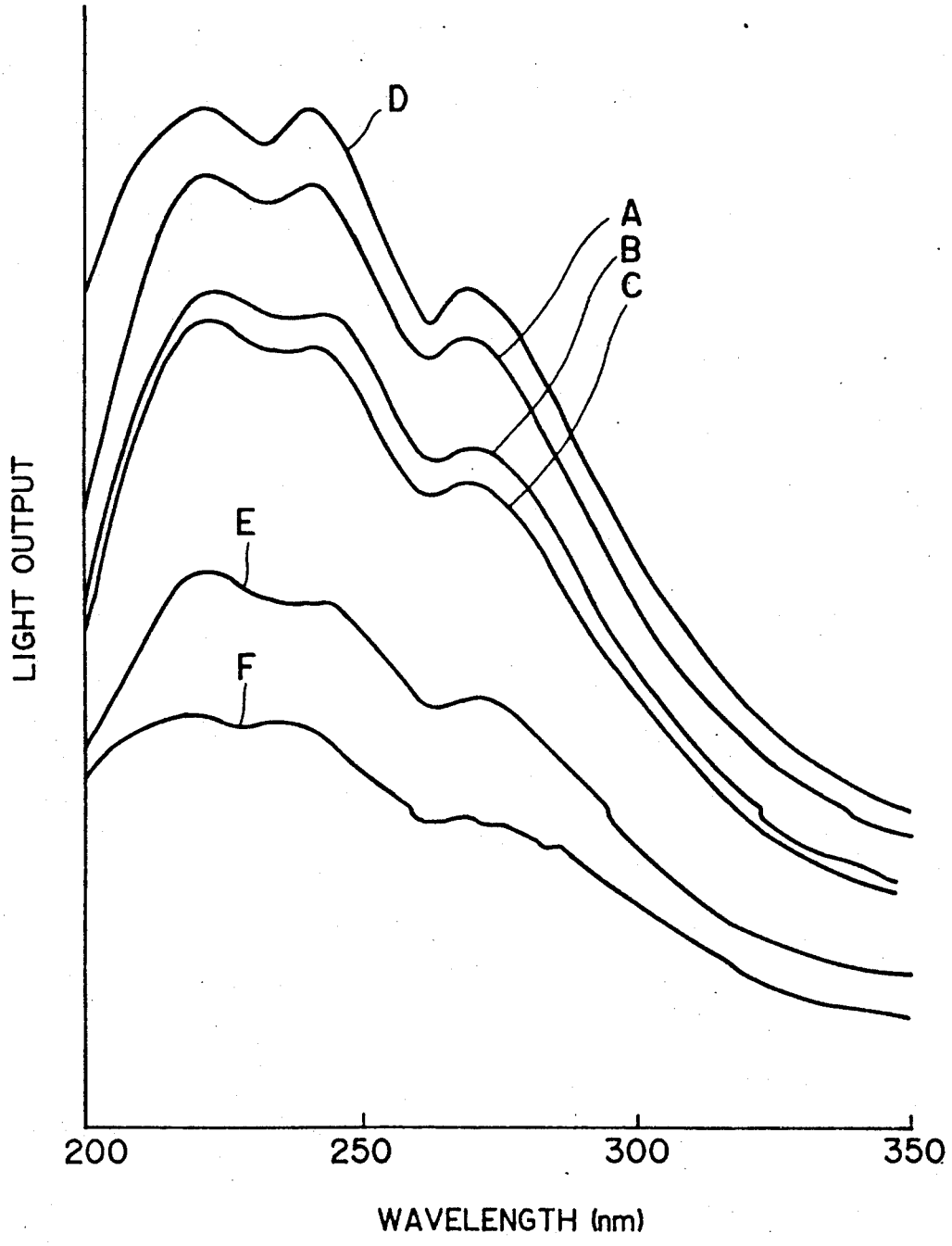
FIG. 13 is a graphical representation showing characteristic curves (the relationship between an optical output and wavelength) of the gas discharge tubes according to the present invention and a conventional gas discharge tube.

FIG. 13 shows characteristic curves for a comparison of light outputs when using the conventional shield member and the shield member according to this invention. In the experiments, discharge current was 0.3 A, and tube voltage was 75 plus/minus 5 V. Further, other conditions were the same to each other for providing the plasma arc.

Characteristic curve A represents data of a discharge tube provided with the shield member 10*d* of the fourth embodiment (FIG. 8) where it surrounds the entire outer peripheral portion of the conical apertured portion 5. A diameter (d) of the apertured portion 5*a* was 0.6 mm. A curve B represents data of a discharge tube provided with a linear shield member 10 of the first embodiment shown in FIG. 4. The diameter d was 0.6 mm. A curve C represents data of a discharge tube provided with the shield member 10*c* of the third embodiment shown in FIG. 7. The diameter d was 0.6 mm. A curve D represents data according to the sixth embodiment of this invention($L_3$=4.0 mm, $\theta$=60 degrees, and d=0.6 mm). A curve E represents data according to the first embodiment shown in FIG. 4. The diameter d was 1.0 mm. A curve F represents data of the conventional gas discharge tube shown in FIGS. 1 through 3. The diameter d was 1.0 mm.

Judging from these characteristic curves, the curves A, B and C provided light amount by not less than 20% greater than that of the curve F. Further, according to these characteristic curves, the curve D provided the light amount 70% greater than that of the curve F, and provided 2.5 times as large as the brightness of the conventional tube. Incidentally, various experiments were conducted with varying $L_3$ and $\theta$. As a result, an increase in brightness was not so greatly changed irrespective of the value $\theta$, but was greatly dependent on the value $L_3$. Therefore suitable apex angle is selected in view of the ease of machining to the conical surface.

Thus, conclusion reaches that the gas discharge tube of the present invention can provide superior advantages over the conventional gas discharge tube.

As described above, according to the present invention, the flow of the electrons from the cathode 8 to the anode 3 is approximately linearly directed into the conical apertured portion 5 along the optical axis 2. Therefore, plasma region 16 can be formed along the optical axis 2. Consequently, the gas discharge tube as a point light source can provide an improved brightness.

Particularly, according to the first through sixth embodiments, the electron flow from the cathode passes along the tip end portion of the shield member and the electrons are converged on the conical apertured portion and reach the anode. In this case, the shield member is positioned as close as possible to the electron convergent portion, so that the flow of the electrodes is linearly directed or incident in parallelism with the optical path. Thus, highly concentrated plasma region can be provided on the conical apertured portion along the optical axis, and consequently, brightness of a point light source can be increased.

Further, in the sixth through eighth embodiments, the conical apertured section and the shield member section are provided as one unit for providing the resultant conical portion having sufficient depth. In this case, the flow the electrons from the cathode to the anode can be approximately linearly directed into the resultant conical portion along the optical axis by making the depth of the resultant conical portion substantially equal to or greater than the depth of the plasma region 16. Therefore, the plasma region can be concentratedly formed along the optical axis. Consequently, the gas discharge tube as a point light source can provide an improved brightness.

While the invention has been described in detail and with reference to specific embodiments thereof, it would be apparent to those skilled in the art that various changes and modifications may be made therein without departing from the spirit and scope of the invention.

What is claimed is:

1. A gas discharge tube comprising:

an outer envelope in which a gas is hermetically enclosed;

an anode disposed in the outer envelope;

a cathode disposed in the outer envelope, a flow line of electrons being provided between the cathode and the anode;

a first shield cover for surroundingly covering the anode and the cathode, the first shield cover having a front section formed with an opening which has a center point;

a second shield cover positioned inside the first shield cover at a position immediately adjacent the anode and between the cathode and the anode;

a plasma arc generating portion positioned at the second shield cover for generating a plasma arc, the plasma arc generating portion having one end formed with a bore which provides a center point and confronts the anode and another end formed with an internal conical portion and confronting the front section of the first shield cover, an optical axis extending on a line connecting between the center points of the bore and the opening, and the cathode being positioned offset from the optical axis; and a shield member positioned between the cathode and the anode and at a position immediately adjacent the another end portion of the plasma arc generating portion for largely bending the flow line of the electrons at a tip end portion of the shield member and for directing the flow line substantially coincident with the optical axis.

2. The gas discharge tube according to claim 1, wherein at least the tip end of the shield member is positioned in the vicinity of the plasma arc generating portion for refracting the flow line of the electrons at a position adjacent the optical axis and for directing the flow line coincident with the optical axis toward the plasma arc generating portion.

3. The gas discharge tube according to claim 1, wherein the cathode has an electron radiating portion, and the shield member is of a linear shape having a longitudinal length larger than an axial length of the plasma arc generating portion.

4. The gas discharge tube according to claim 2, wherein the cathode has an electron radiating portion, and the shield member is of a linear shape having a longitudinal length larger than an axial length of the electron radiating portion.

5. The gas discharge tube according to claim 1, wherein the shield member is of a tubular shape positioned to surround the another end portion of the plasma arc generating portion, the shield member having a length for sufficiently confining the plasma arc within the plasma arc generating portion and within the shield member.

6. The gas discharge tube according to claim 2, wherein the shield member is of a tubular shape positioned to surround the another end portion of the plasma arc generating portion, the shield member having a length for sufficiently confining the plasma arc within the plasma arc generating portion and within the shield member.

7. The gas discharge tube according to claim 5 wherein the shield member is of a cylindrical shape and provided concentrical with the plasma arc generating portion.

8. The gas discharge tube according to claim 7 wherein the cylindrical shield member is provided integrally with the plasma arc generating portion, and has a conical surface portion contiguous with the internal conical portion to provide a resultant conical portion.

9. The gas discharge tube according to claim 8, wherein the resultant conical portion provides an axial length of not less than 2 mm.

10. The gas discharge tube according to claim 8, wherein the resultant conical portion provides an apex angle ranging from 30 to 120 degrees.

* * * * *